US005577485A

United States Patent [19]

Lindsley

[11] Patent Number: 5,577,485

[45] Date of Patent: Nov. 26, 1996

[54] IGNITION SYSTEM

[75] Inventor: Nathaniel L. Lindsley, Lebanon, Tenn.

[73] Assignee: International Machinery Corporation, Mount Juliet, Tenn.

[21] Appl. No.: 487,338

[22] Filed: Jun. 7, 1995

[51] Int. Cl.[6] ..... F02P 3/04; F02P 7/07; F02P 11/00

[52] U.S. Cl. ..... 123/617; 123/143.006; 123/633; 123/651

[58] Field of Search ..... 123/143 C, 617, 123/633, 643, 651, 647

[56] References Cited

U.S. PATENT DOCUMENTS

| | | | |
|---|---|---|---|
| 1,837,255 | 12/1931 | DuPont et al. | 123/143 C |
| 2,462,491 | 2/1949 | Hallet | 361/816 |
| 2,675,415 | 4/1954 | Cushman | 123/633 |
| 2,768,227 | 10/1956 | Ruckelshaus | 123/633 |
| 2,811,672 | 10/1957 | Gilbert | 315/163 |
| 3,556,068 | 1/1971 | Varaut | 123/652 |
| 3,587,549 | 6/1971 | Kebbon | 123/598 |
| 3,621,827 | 11/1971 | Milrot | 123/651 |
| 4,406,272 | 9/1983 | Kiess et al. | 123/617 |
| 4,459,968 | 7/1984 | Brandt et al. | 123/643 |
| 4,508,092 | 4/1985 | Kiess et al. | 123/617 |
| 4,669,443 | 6/1987 | Oetting et al. | 123/143 C X |
| 4,903,674 | 2/1990 | Bassett et al. | 123/634 |
| 4,918,569 | 4/1990 | Maeda et al. | 361/263 |
| 5,014,005 | 5/1991 | Murata et al. | 324/207.2 |
| 5,113,839 | 5/1992 | Hartmann et al. | 123/606 |
| 5,158,056 | 10/1992 | King | 123/414 |
| 5,220,903 | 6/1993 | Niemetz | 123/651 |

FOREIGN PATENT DOCUMENTS

| | | | |
|---|---|---|---|
| 2422044 | 2/1979 | France | 123/617 |

*Primary Examiner*—Tony M. Argenbright
*Attorney, Agent, or Firm*—Hazel & Thomas

[57] ABSTRACT

A modular electronic ignition system for use in internal combustion engines is provided using latching Hall effect sensing devices. Two permanent magnets are affixed to a non-ferrous member mounted to the camshaft which extends through a seal in the timing cover. A sensing module comprising the Hall effect devices is arranged annularly or angularly about the magnet containing member and senses the magnetic field as the magnets pass the Hall effect devices. Dwell time is controlled by the angular distance at which the magnets are placed from each other. The output of the Hall effect devices drives application specific integrated circuits which provide low level switching of ignition coil primaries. The modular design allows for a low part count, a simplified EMI shielding arrangement, and easy removal and replacement of system components.

16 Claims, 3 Drawing Sheets

IGNITION SYSTEM

BACKGROUND OF THE INVENTION

1. Field of the Invention

The present invention relates generally to ignition systems for use in internal combustion engines and more particularly to an ignition system for use in internal combustion engines employing magneto-responsive solid state sensing devices.

2. Description of the Prior Art

Ignition of the fuel to air mixture in internal combustion engines by electric spark has been achieved in many ways. Regardless of the system implemented, there exists the fundamental necessity to provide and deliver a high voltage pulse to the spark plugs with sufficient energy content to create an electric arc between center electrodes and ground electrodes of the spark plugs. In addition, the high voltage pulse must be delivered to each spark plug at the appropriate time and for an appropriate duration of time. Modern systems typically have sensor or triggering means that sense, via an angular position of a crankshaft, when a piston in a particular cylinder is entering a power stroke in the engine cycle and relay that information in some manner. Processing circuitry with high voltage, high current switching means is used to energize a primary coil of an ignition coil and a secondary coil delivers a high tension pulse to the spark plugs. One drawback to the known systems is that it is necessary that all the ignition processing circuitry be RF shielded. Poor shielding can lead to system malfunction or complete failure, particularly in those systems that require microprocessors. High tension wires, i.e. spark plug wires, must also be shielded so as not to affect ignition processing circuitry as well as other electronic devices such as car stereos, car phones, and the like.

As stated, sensing and triggering means exist that sense the angular position of an engine's crankshaft either directly or indirectly. Presently, inductive sensing means are most often implemented. Inductive sensing requires that a magnetic field at the sensor change. Although a change in magnetic flux induces a voltage in a conductor, magneto-responsive devices are not always "inductive" in that sense. A magnetic field may be used to effect sensor output in which the magnitude and not a change in flux of the field causes a sensor output to change. Hall effect elements, and the devices in which they are used, are examples of magneto-responsive solid-state devices that do not work on the principle of rate of change induced voltage. Instead, a magnetic field perpendicular to the flow of current causes a difference in electric potential throughout a conductor or semiconductor. The resulting voltage is referred to as the Hall voltage. The output voltage of a sensor of this type as effected by the Hall voltage is independent of the rate of change of the magnetic field being sensed.

The advantages of using a Hall effect device, versus other magnetic means for crank angle sensing, include: (1) smallest package size; (2) low cost; (3) minimum parts count; (4) sharp trigger response; (5) good resistance to environmental effects.

Latching Hall effect devices provide an advantage in that timing intervals can be set with two very small permanent magnets. This contrasts with more involved external means of extending the response of non-latching devices that are known. The prior art teaches the use of a single Hall effect device, namely a bipolar two-output Hall device, that is spaced between a pair of opposing permanent magnets. Dual magnetic flux fields of the same magnitude are generated at the Hall effect device which cancels the effect on the device. A crankshaft mounted disk carries metallic tabs in specific relation to shunt the magnetic field between one and then the other of the magnets and the Hall effect device at predetermined intervals which allows the device to be actuated by the remaining magnetic field at the sensor. One of the outputs of the bipolar Hall device, depending on which field is shunted, relays the sensor output to one of two input channels of a microprocessor. The related output channel of the microprocessor is input to a related coil driver, ignition coil, and then the spark producing means of two of four cylinders. The dwell time, i.e., the time for which a primary coil is energized to saturation before the collapse of the magnetic field in the ignition coil and thereby inducing a high voltage pulse in the secondary coil which is grounded through the spark plugs, is determined by the length of a metallic tab. The longer the tab, the longer the Hall effect device produces a Hall voltage, which, by way of some intermediate circuitry, energizes the primary coil. Similarly, a single magnet and two single output Hall effect devices are taught and function in a like fashion. In both cases, the sensor is arranged to sense the angular position of the crankshaft in direct relation to the crankshaft's rotation. Because the crankshaft makes two complete revolutions per power stroke in a given cylinder in four stroke cycle engines, the ignition coil or coils are fired twice during one complete engine cycle for a particular cylinder. One of the firings is delivered between exhaust and intake strokes and is of no benefit. In fact, this doubles the necessary burden of the system.

Also known in the art is a solid state ignition system utilizing a non-latching Hall effect switch as a means of advancing and retarding the ignition timing. The Hall effect switch is activated by a D.C. biasing voltage which is induced in a coil by permanent magnets carried on the rotatable member of a small, single cylinder, magneto fired engine. The use of the Hall effect switch in this application differs greatly from that previously described.

Examples of the above-described devices may be found in U.S. Pat. Nos.: 4,155,340; 4,508,092; 4,406,272; 5,158,056; 5,014,005; 4,903,674; 3,556,068; 2,768,227; 4,918,569; 5,113,839; 3,587,549; 2,811,672; and 3,621,827. Additionally, French Patent 2,422,044 and U.S. Pat. Nos. 2,675,415 and 2,462,491 may be of interest.

SUMMARY OF THE INVENTION

It is therefore an object of the present invention to provide an improved solid state, contactless ignition system for internal combustion engines.

A further object of this invention is to provide an improved solid state, contactless ignition system for internal combustion engines, having a simpler, more reliable design.

It is another object of this invention to provide an improved solid state, contactless ignition system for internal combustion engines, of modular form to permit removal and replacement of the system components quickly and easily.

It is yet another object of this invention to provide an improved, solid state, contactless ignition system for internal combustion engines, having a simplified EMI shielding arrangement.

Briefly, these and other objects may be achieved by a system which employs inductive sensing using four Hall effect latching integrated circuits, two camshaft mounted miniature permanent magnets, four application specific integrated circuit coil driver devices, and two modular snap-on firing modules.

Other objects and features of the present invention will be apparent from the following detailed description of the preferred embodiment.

BRIEF DESCRIPTION OF THE DRAWING

The invention will be further described in conjunction with the accompanying drawings, in which.

DETAILED DESCRIPTION OF THE PREFERRED EMBODIMENT

Figure 1:
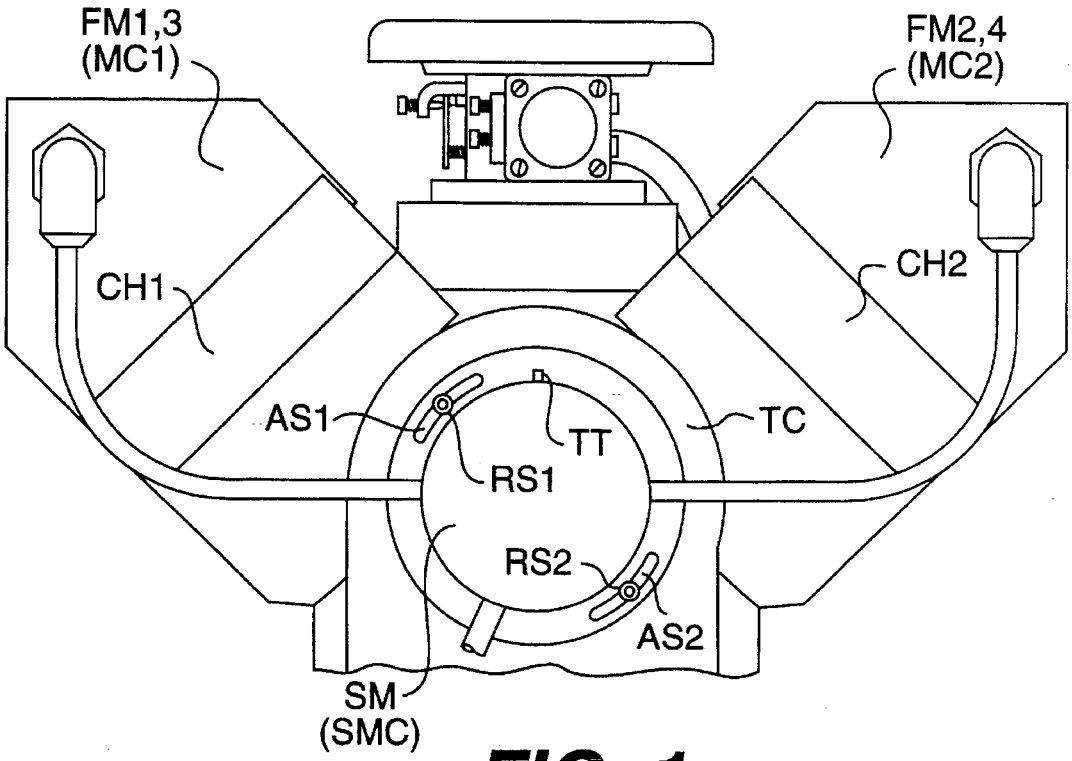
FIG. 1 is the front view of a four cylinder, four stroke internal combustion engine having an ignition system according to the invention.

With reference to the Figures, wherein like reference characters indicate like elements throughout the several views and, in particular, with reference to FIG. 1, the front view of an internal combustion engine is depicted with the solid state ignition system according to the present invention. A sensing module SM is depicted which is attached to a "timing cover" TC with two retaining screws RS1 and RS2, which penetrate cover TC through two adjustment slots AS1 and AS2 in module SM flange. Module SM may be rotated clockwise or counterclockwise by loosening screws RS1 and RS2 and applying force to a timing tang TT affixed to a cover SMC of module SM. Rotating module SM causes an advancement or retardation of the ignition timing as will be shown. Also depicted are two firing modules FM1,3 and FM 2,4. More precisely, it is the firing module covers MC1 and MC2 that are shown in FIG. 1 which are similar in appearance to conventional valve covers and snap onto the cylinder heads CH1 and CH2. Covers MC1 and MC2, and the components housed by and attached thereto, make up modules FM1,3 and FM2,4 which are identical and interchangeable. The components that make up modules FM1,3 and FM2,4, and the functions thereof, will be explained in conjunction with FIGS. 2, 6, 7 and 8.

Figure 2:
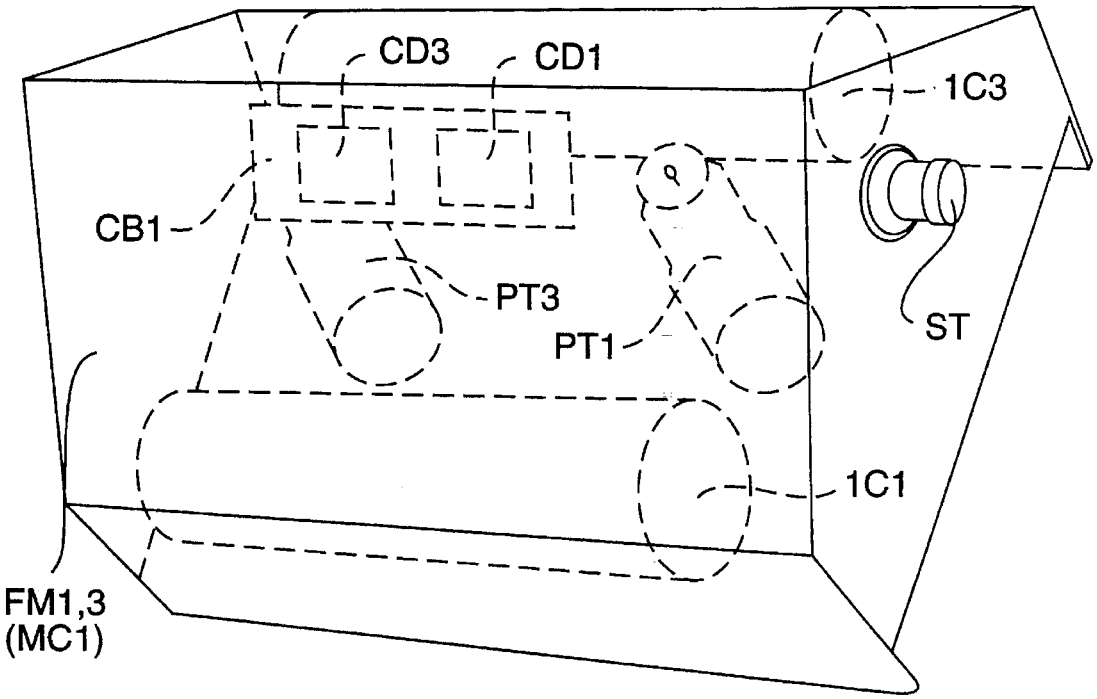
FIG. 2 is a see-through view of a firing module cover showing the position of the firing circuit components therein according to the invention.

Referring now to FIG. 2, which depicts firing module FM1,3, according to the invention with the internal components being shown with dashed outlines, module FM1,3 comprises a dual coil driver circuit board CB1, two ignition coils IC1 and IC3, two spark plug towers PT1 and PT3, firing module cover MC1, sensor output receiving terminal ST, as well as wire conducting means between the components as required. The wire conducting means have been omitted from FIG. 2 for clarity. The sensor output signal from module SM is transmitted to terminal ST via a shielded conductor (not shown). The sensor output signal is transmitted from terminal ST to circuit board CB1 which contains two application specific integrated circuits CD1 and CD3, hereafter referred to as ASIC coil drivers, which provide low level switching for the primary coils of coils IC1 and IC3. Output from circuit board CB1 drives coils IC1 and IC3 which in turn provide a high voltage output via high voltage leads to two spark plug terminals (not shown). The high voltage leads are secured to the spark plug terminals through towers PT1 and PT3. Electrical contact between the leads and the spark plug terminals is maintained under spring pressure. All high voltage components, as identified above, are contained within cover MC1, which by means of contact to the engine structure, provides EMI shielding which satisfies EMC requirements worldwide. Said EMI shielding cannot be defeated when module FM1,3 is properly attached to the cylinder head (not shown). It should be again noted that module FM2,4 is identical and operates identically for the remaining two cylinders of the present embodiment of the invention.

Figure 3:
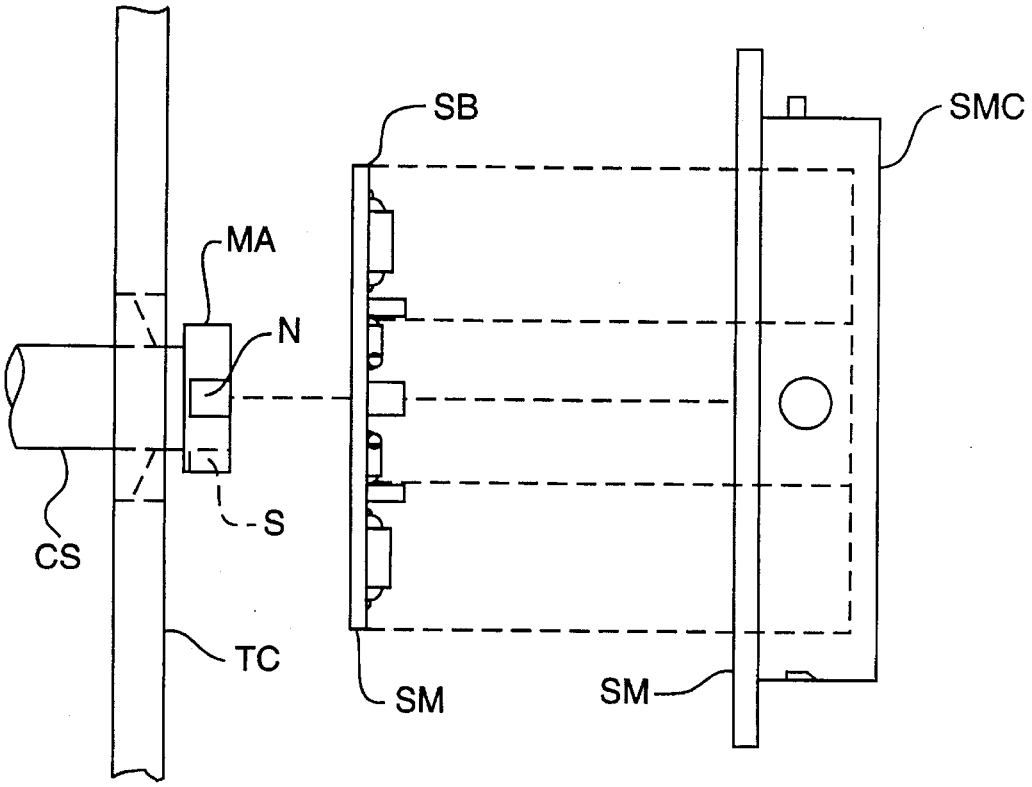
FIG. 3 is an expanded side view of the camshaft magnet adapter and sensing module according to the invention.

Referring now to FIG. 3, which depicts an expanded side view of a camshaft magnet adapter MA and module SM. The module SM's circuit board SB, which contains four identical latching Hall effect integrated circuit devices and related circuitry, later described, is shown as is cover SMC. The advantages of using a Hall effect device, versus other magnetic means for crank angle sensing, include: (1) smallest package size; (2) low cost; (3) minimum parts count; (4) sharp trigger response; (5) good resistance to environmental effects.

Latching Hall effect devices provide an advantage in that timing intervals can be set with two very small permanent magnets. This contrasts with more involved external means of extending the response of non-latching devices that are known. Also shown is adapter MA to which are affixed two miniature permanent magnets, N and S. Magnets N and S are mounted at 90 degrees to each other at the outer edge of adapter MA. The poles of magnets N and S at the outer edge of adapter MA differ; N is the north pole and S is the south pole. Adapter MA is mounted to an extension of camshaft CS, which protrudes through a sealed opening in cover TC. As will be seen in later Figures, adapter MA, circuit board SB, and cover SMC are all aligned in concentric relation with necessary operating clearance provided between adapter MA and circuit board CB.

Figure 4:
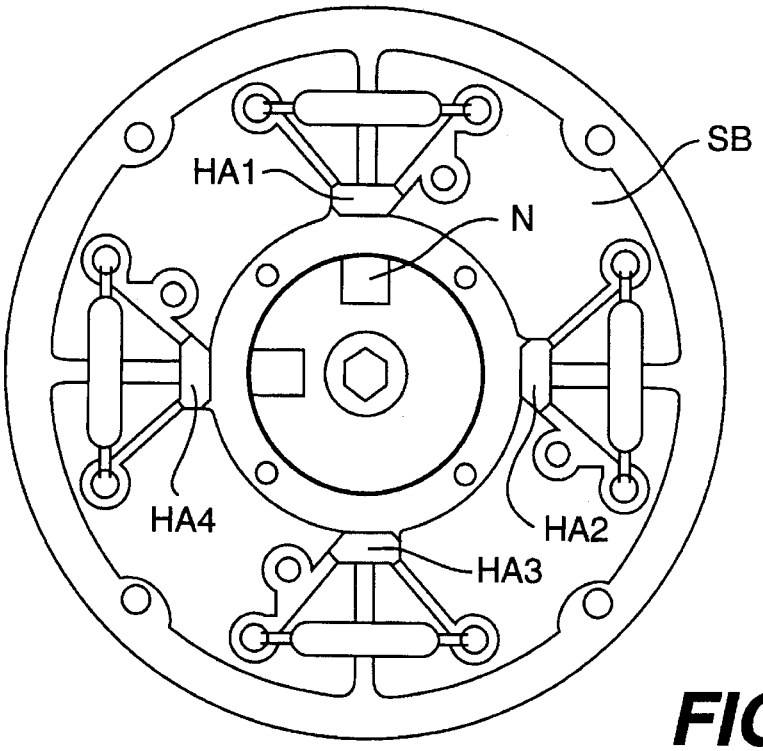
FIG. 4 is a front view of the camshaft magnet adapter and sensing module circuit board according to the invention.

Referring now to FIG. 4, which depicts a front view of circuit board SB, adapter MA, devices HA1 through HA4 and related circuitry, again magnets N and S are shown at 90 degrees to each other with N being North pole outwardly arranged and S being south pole outwardly arranged. For clockwise rotation of the camshaft CS at a constant speed, any one of the devices, HA1 through HA4, will therefore experience the magnetic field of magnet N and then that of S at shorter intervals then between S and N. Devices HA1 through HA4 are arranged at 90 degree intervals near the inner edge of circuit board SB. All have identical related circuitry which will be explained in detail in reference to FIG. 5 which follows.

Figure 5:
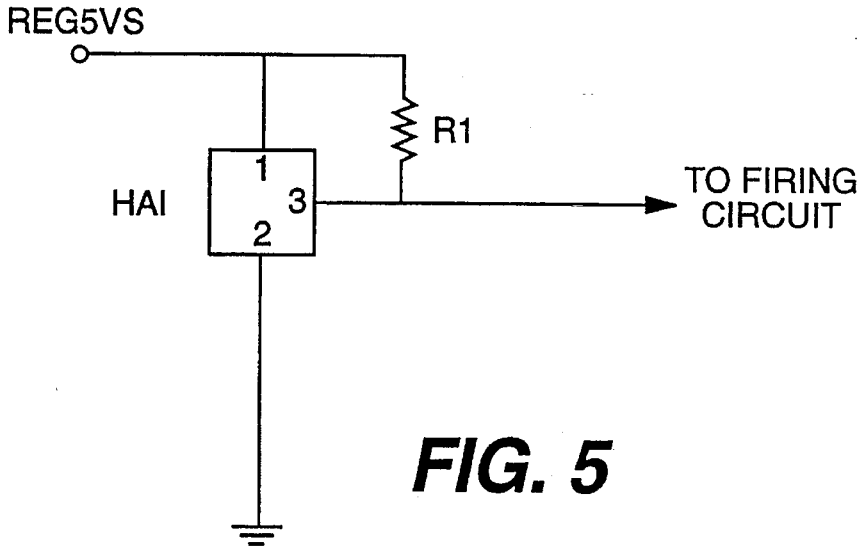
FIG. 5 is a schematic of the Hall effect sensor circuit according to the invention.

Referring now to FIG. 5, which is a schematic of the components of one of the four identical sensing circuits mounted to circuit board SB, the circuit shown comprises an A3185E solid state latching Hall effect integrated circuit HA1, and a 250 ohm resistor R1. A regulated voltage source 5 VS is connected to pin 1 of the solid state latching Hall effect integrated circuit HA1, as well as one side of resistor R1. Pin 2 is grounded. The remaining side of resistor R1 is connected to the output of HA1 at pin 3. The output of HA1 at pin 3 is connected to the firing circuit not shown. In the present embodiment, this regulated source maintains 5 volts at pin 1 of the solid state latching Hall effect integrated circuit HA1, which provides a biasing voltage to HA1.

Resistor R1 is used to hold the voltage at pin 3 of the solid state latching Hall effect integrated circuit HA1 high when the solid state latching Hall effect integrated circuit HA1 is in an off state.

Figure 6:
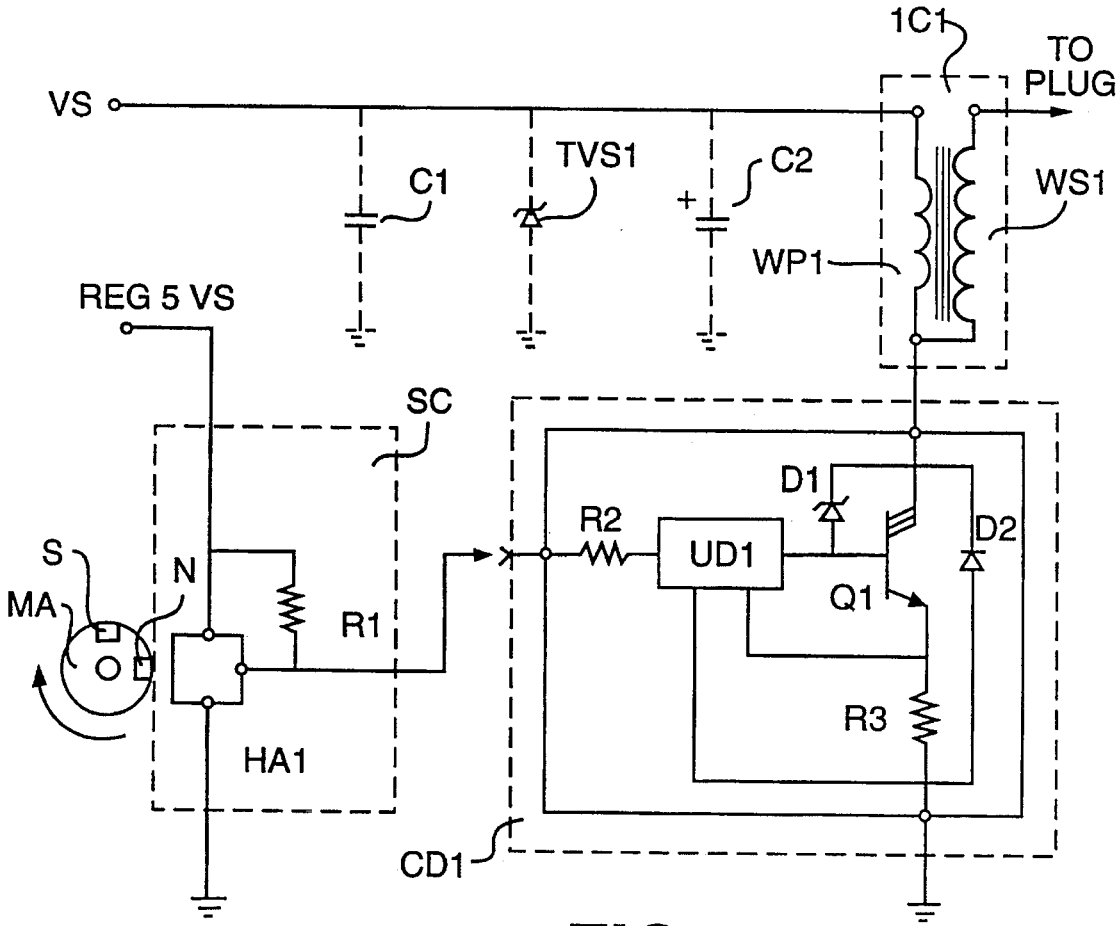
FIG. 6 is a functional electrical diagram of the complete sensing and firing elements for one cylinder according to the invention.

Referring now to FIG. 6, which is a functional electrical diagram of the complete sensing and firing elements necessary for one cylinder, adapter MA is depicted with magnets N and S. An arrow is shown to indicate clockwise rotation. The sensing circuit previously described in reference to FIG. 5 is shown here generally as sensing circuit SC. ASIC CD1, VB921ZVSP coil driver power 1C, is a proprietary design of SGS-Thomson Microelectronics, and is comprised of resistors R2 and R3, zener diode D1, diode D2, vertical current flow power trilington transistor Q1 and integrated control circuit UD1. Ignition coil IC1 containing primary coil WP1, and secondary coil WS1 are shown, as are capacitors C1 and C2, and transient voltage suppressor TVS1. A voltage source VS is connected to one side of primary coil WP1, the other side of which is switched to ground by ASIC CD1.

It should be understood that the following explanation concerning the operation of the ignition system according to the instant invention, in reference to FIG. 6, applies to the remainder of the sensor and firing circuits identically. Because the operation of the ignition system is repetitive in nature, the explanation to follow will assume an arbitrary starting point. For that reason, adapter MA will be assumed to be rotating clockwise as indicated and magnet N will be assumed to be proximate to the solid state latching Hall effect integrated circuit HA1. The field of magnet N causes the solid state latching Hall effect integrated circuit HA1 to release the output at pin 3 from ground. Upon doing so, 5 volts are applied to the output at pin 3. The 5 volts are applied to the ASIC coil driver CD1 closing transistor Q1 causing the low side of coil WP1 to be grounded. As a result, current then flows through WP1 and a magnetic field builds in coil IC1. The field is allowed to build until such time as device HA1 is once again activated by the presence of an opposing magnetic field. This quality distinguishes latching Hall effect devices from non-latching Hall effect devices, which do not maintain the operative state of the device in the absence of an actuating field incident of the device.

As magnet S passes the solid state latching Hall effect integrated circuit HA1, the output of the solid state latching Hall effect integrated circuit HA1 at pin 3 is grounded. Transistor Q1 is driven to the off state. With transistor Q1 open, current flow in WP1 ceases and the field acquired in coil IC1 collapses. A high tension voltage is induced in the secondary coil, WP2, which is grounded through a spark plug. The resulting arc between the plug's electrodes ignites the charge in the cylinders. Diodes D1 and D2 are for circuit protection. D1 provides collector voltage clamping, D2 dampens flyback spikes generated by collapse of the coil field and UD1 amplifies, controls and provides coil current limiting. The coil IC1 is not energized again until the passing of N at which point the cycle repeats as previously described. Transient voltage suppressor TVS1 and capacitors C1 and C2 are optional and serve to reduce noise in the system.

In a second embodiment (not shown), field effect transistors, driven by high speed drivers, are used for low level switching for the primary coils. It should be noted that, while a preferred embodiment of the invention would use the ASIC coil drivers previously discussed, many systems are known which are capable of providing low level switching of the primary coils.

It should be appreciated that, although the magnets have been described as being placed at 90 degrees to each other in the instant invention, the annular distance between magnets N and S determines the dwell time, which may appropriately be desired less than that which would result in the system as described above. Furthermore, the passing of magnet S, and the ignition of the charge in a given cylinder shortly thereafter, corresponds generally to the point in time when a piston has reached top dead center, or the accepted number of degrees before top dead center, in anticipation of a power stroke. Therefore, the annular distance between sensors should be equal regardless of the number of cylinders a particular engine utilizing such a system as has been described above may have. It should also be understood that by rotating module SM relative to the camshaft's angular position, the timing of the spark to all cylinders is either advanced or retarded equally.

A contactless and distributorless ignition system has been described, possessing many desirable qualities. The use of latching Hall effect devices allows for a simplified sensing arrangement and method of dwell control. By sensing the rotational position of the camshaft, a spark is provided to each cylinder only once during a cycle rather than twice, thereby relieving the system of an unnecessary burden. The system is essentially comprised of only four basic components, a non-ferrous adapter with two permanent magnets affixed to a camshaft which extends through a seal in the timing cover, a sensing module, and two identical firing modules. This modular design allows for easy removal and replacement of the components which may reduce the time and cost of repair. Further, because all high tension components are RF and EMI shielded by the firing module cover, individual shielding for many components is avoided and the wiring necessary for the system is reduced. Also, because the circuitry is well protected from outside elements and the firing modules and sensing module employ very simple, solid covers, the entire engine may be externally cleaned easily, without affecting the ignition system's operation.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. An electronic ignition system, comprising:

means for periodically generating magnetic fields of opposite polarity;

means for sensing the presence of first and second polarities of said generated magnetic fields, said sensing means including a plurality of latching Hall effect sensing devices, wherein each of said Hall effect sensing devices has means for building up a stored output signal in response to said first polarity of said generated magnetic fields, and means for outputting said stored output signal in response to a second polarity of said generated magnetic fields; and means for generating a high voltage ignition signal in response to said outputted output signal.

2. The electronic ignition system of claim 1, wherein said means for periodically generating said magnetic fields of opposite polarity comprises a non-magnetic rotating member with affixed, spaced apart magnetic elements of opposite polarity.

3. The electronic ignition system of claim 2, wherein said non-magnetic rotating member is a disk and said spaced apart magnetic elements are permanent magnets with poles of opposite polarity outwardly arranged on said disk.

4. The electronic ignition system of claim 3, wherein said rotating member is fixed to a camshaft of an internal combustion engine.

5. The electronic ignition system of claim 4 wherein said camshaft is extended through a seal in a timing cover of said internal combustion engine.

6. The electronic ignition system of claim 3, wherein said latching Hall effect sensing devices are annularly arranged relative to each other about an axis of rotation of said rotating member, said latching Hall effect sensing devices further being arranged on a plane adjacent and parallel to said rotating member.

7. The electronic ignition system of claim 1, wherein said means for building up a stored output signal includes an electronic gain device.

8. A system for providing radio frequency (RF) and electromagnetic interference (EMI) shielding for an electronic ignition device, comprising:

means for generating high voltage ignition signals;

circuit means for controlling operation of said ignition signal generating means; and shielding means for providing RF and EMI shielding for said ignition signal generating means and said circuit means, wherein said ignition signal generating means and said circuit means are integrally mounted in an interior space of said shielding means, and said shielding means is mounted on an engine structure.

9. The system of claim 8, wherein said control circuit means includes an electronic gain device and an electronic switching device, and said ignition signal generating means includes an ignition coil.

10. The system of claim 9 wherein said electronic switching device is a bipolar transistor.

11. The system of claim 9 wherein said electronic switching device is a field effect transistor.

12. The system of claim 9 wherein said electronic gain device is an integrated control circuit.

13. The system of claim 8, wherein said shielding means includes a single metal cover enclosing said ignition signal generating means and said control circuit means in an interior space thereof.

14. The system of claim 13, wherein said shielding means includes a cylinder head cover.

15. An electronic ignition system comprising:

a non-ferrous disk with two permanent magnets of opposite polarity fixed thereto, said non-ferrous disk being fixed to a camshaft of an internal combustion engine;

a plurality of latching Hall effect sensing devices, each of said Hall effect sensing devices for sensing a polarity of said permanent magnets during rotation of said rotating disk, said plurality of Hall effect sensing devices being annularly arranged relative to each other about an axis of rotation of said disk, and along a plane parallel and adjacent to said disk;

means for generating high voltage ignition signals to be outputted to at least one spark plug of said internal combustion engine in response to said plurality of Hall effect sensing devices sensing said polarity of said permanent magnets; and shielding means for providing radio frequency and electromagnetic interference shielding for at least said ignition signal generating means, wherein said shielding means is mounted on said internal combustion engine, and said ignition signal generating means is integrally mounted in an interior of said shielding means.

16. The electronic ignition system of claim 15 wherein said electronic ignition system is for an internal combustion engine containing multiple cylinders.

* * * * *